US005221178A

United States Patent [19]

Yoshioka et al.

[11] Patent Number: 5,221,178

[45] Date of Patent: Jun. 22, 1993

[54] CIRCUMFERENTIAL FLOW TYPE LIQUID PUMP

[75] Inventors: Hiroshi Yoshioka; Shingo Iwai, both of Hiroshima, Japan

[73] Assignee: Mitsubishi Denki Kabushiki Kaisha, Tokyo, Japan

[21] Appl. No.: 858,434

[22] Filed: Mar. 24, 1992

Related U.S. Application Data

[63] Continuation of Ser. No. 618,897, Nov. 28, 1990, abandoned.

[30] Foreign Application Priority Data

Dec. 26, 1989 [JP] Japan ..... 1-341437

[51] Int. Cl.[5] ..... F04D 5/00

[52] U.S. Cl. ..... 415/55.1; 415/169.1

[58] Field of Search ..... 415/55.1-55.7, 415/169.1

[56] References Cited

U.S. PATENT DOCUMENTS

| | | | |
|---|---|---|---|
| 4,205,947 | 6/1980 | Ruhl et al. | 417/199 A |
| 4,591,311 | 5/1986 | Matsuda et al. | 415/55.1 |
| 4,673,333 | 6/1987 | Kluge | 415/55.1 |
| 4,793,766 | 12/1988 | Kumata | 415/55.1 |
| 4,844,621 | 7/1989 | Umemura et al. | 415/55.5 |

FOREIGN PATENT DOCUMENTS

| | | | |
|---|---|---|---|
| 60-79193 | 5/1985 | Japan . | |
| 138297 | 7/1985 | Japan | 415/55.1 |
| 671309 | 4/1952 | United Kingdom . | |
| 776635 | 6/1957 | United Kingdom . | |
| 1581387 | 12/1980 | United Kingdom . | |
| 2134598 | 8/1984 | United Kingdom | 415/55.6 |

*Primary Examiner*—John T. Kwon

*Attorney, Agent, or Firm*—Leydig, Voit & Mayer

[57] ABSTRACT

A circumferential flow type liquid pump includes an impeller with vanes on its outer periphery, and a pump casing assembly defining an arcuate elongated pump flow path along the outer periphery of the impeller and a suction inlet and a discharge outlet at both ends of the pump flow path. The pump casing assembly includes a radially-extending gas venting path which is opened in the inner periphery of the pump flow path near the impeller and separated by a step from the bottom of the pump flow path, and a through-hole much larger in sectional area than the gas venting path, through which the gas venting path is communicated with the outside of the pump casing assembly. Bubbles formed by vaporization of the fuel in the pump flow path are positively discharged from the pump casing assembly, and no vapor locking is caused.

7 Claims, 2 Drawing Sheets

CIRCUMFERENTIAL FLOW TYPE LIQUID PUMP

This application is a continuation of application Ser. No. 07/618,897, filed Nov. 28, 1990, now abandoned.

BACKGROUND OF THE INVENTION

This invention relates to circumferential flow type liquid pump, and more particularly to a circumferential flow type liquid pump used as a fuel pump for pumping a liquid-phase fuel such as gasoline from the fuel of a vehicle equipped with an internal combustion engine.

FIGS. 4 and 5 are sectional views showing a pump which is the same in type as a conventional circumferential flow type liquid pump disclosed by Japanese Published Unexamined Patent Application No. 79193/1985. In these figures, reference numeral 1 designates a pump casing assembly which comprises a pump casing body 2 and a cover 3. The pump casing assembly accommodates an impeller 4 with vanes 5 on its periphery. The impeller 4 is mounted on a central shaft 6 so that it is rotated around the central axis with respect to the pump casing assembly 1.

In the pump casing assembly 1, an arcuate elongated pump flow path 7 with a suction inlet 8 and a discharge outlet 9 at both ends is defined in such a manner that it is extended along the outer periphery of the impeller 4 and receives the vanes 5 of the impeller 4.

The upstream end portion of the pump flow path 7 which is on the side of the suction inlet is formed into an enlarged flow path *7a* having a predetermined length which is larger in section than the remaining portion, and accordingly lower in internal pressure than the latter, and it has a step *7b* at the end where its sectional area is decreased in other words, the remaining portion of the pump flow path 7 between the step *7b* and the discharge outlet 9 is smaller in sectional area than the enlarged flow path *7a*, and accordingly higher in internal pressure than the latter *7a*. A small hole, namely, a gas venting hole 14 is formed in the enlarged flow path near the step *7b* so that the pump flow path is communicated with the pump casing assembly 1.

The central shaft 6 of the impeller 4 is the rotary shaft of the rotor 16 of an electric motor 15, and it is rotatably supported by bearings 17 and 18 at both ends.

Further in FIG. 4, reference numeral 19 designates an end cover which has a check valve 22 and a liquid outlet 23, and supports a bracket 24.

The pump casing assembly 1 is coupled to the end cover 19 through the yoke 20 of the motor 15. The yoke 20 accommodates the rotor 16, and forms a liquid chamber 21 between the pump casing assembly 1 and the end cover 19 to store a liquid such as a liquid fuel discharged through the discharge outlet 9. Permanent magnets 25 as a serving as s mounted on the inner wall of the yoke. The liquid chamber 21 is communicated with the liquid outlet 23 with the check valve 22 which is provided in the end cover 19. The bracket 24 supports brushes 27 which are held in sliding contact with the commutator 26 of the rotor 16.

The operation of the circumferential flow type liquid pump thus constructed will be described.

As the impeller 4 is rotated clockwise in FIG. 5 by the electric motor 15, a liquid such as a liquid fuel is sucked into the pump flow path 7 through the suction inlet 8. The liquid thus sucked is increased in pressure by the fluid friction resistance which is provided by high speed rotation of the vanes of the impeller, so that it is caused to flow clockwise in FIG. 5 and then flow through the discharge outlet 9 into the liquid chamber 21. On the other hand, when the vanes of the impeller contact the liquid, the latter is partially vaporized, thus forming bubbles in the liquid. The bubbles thus formed are also allowed to flow into the liquid chamber 21. If the bubbles are supplied through the liquid chamber 21 into the internal combustion engine, a variety of difficulties are caused. In order to eliminate these difficulties, the gas venting hole 14 is formed in the enlarged flow path near the step to discharge the bubbles out of the pump casing assembly 1.

In a circumferential flow type liquid pump used as a fuel pump, when bubbles are formed in the pump flow path by vaporization of the fuel and remain therein, so-called "vapor locking" occurs to obstruct the flow of liquid, thus greatly lowering the pumping capacity. In order to overcome this difficulty, in a conventional circumferential flow type liquid pump, as was described above the gas venting hole is formed in the pump flow path to communicate the latter with the outside of the pump casing assembly, so that bubbles formed in the pump flow path by vaporization of the liquid are discharged through the gas tenting hole into the outside of the pump casing assembly.

However, since the gas venting hole is a small hole formed in the bottom of the enlarged flow path, there are various problems. That is, when the vanes of the impeller contact the liquid such as liquid fuel in the pump flow path, bubbles are formed therein, and the bubbles flow along the inner circular periphery of the pump flow path because of the difference between the bubbles and the liquid both in centrifugal force and in specific gravity. Hence, in order to discharge the bubbles out of the pump casing assembly, it is necessary to discharge a large quantity of substantially bubble-free liquid which is present near the bottom of the pump flow path out of the pump casing assembly. Furthermore, since the gas venting hole is a small hole formed in the enlarged flow path as was described before, great flow resistance is induced when the bubbles together with the liquid flow through the small hole.

Furthermore, since the gas venting hole is vertical with respect to the bottom of the pump flow path, the dynamic pressure of the vortex in the pump flow path cannot be utilized in discharging the bubbles out of the pump casing assembly; that is, the bubbles must be discharged only by the static pressure in the pump flow path. Accordingly, when the fuel is vaporized very much, sometimes the bubbles formed by vaporization of the fuel are not discharged from the pump casing assembly; that is, it is difficult to prevent the occurence of vapor locking.

SUMMARY OF THE INVENTION

Accordingly, an object of the invention is to eliminate the above-described difficulties accompanying a conventional circumferential flow type liquid pump.

More specifically, an object of the invention is to provide a circumferential flow type liquid pump in which bubbles formed by vaporization of the fuel in the pump flow path are positively discharged from the pump casing assembly, whereby no vapor locking is caused.

The foregoing and other objects of the invention have been achieved by the provision of a circumferential flow type liquid pump comprising an impeller with vanes on its outer periphery, and a pump casing assembly defining an arcuate elongated pump flow path along the outer periphery of the impeller and a suction inlet and a discharge outlet at both ends of the pump flow path, in which, according to the invention, the pump casing assembly includes a gas venting path which is opened in the inner periphery of the pump flow path near the impeller and separated by a step from the bottom of the pump flow path, and a through-hole much larger in sectional area than the gas venting path through which the gas venting path is communicated with the outside of the pump casing assembly.

In the circumferential flow type liquid pump according to the invention, the bubbles formed in the liquid in the pump flow path by vaporization to flow along the inner periphery of the pump flow path near the impeller are discharged as follows. The bubbles are caused to flow into the gas venting path which is opened in the inner periphery of the pump flow path near the impeller and separated by a step from the bottom of the pump flow path and is extended radially or in the direction of the vortex formed in the pump flow path by the impeller, by the static pressure induced in the pump flow path by pumping and the dynamic pressure induced by the vortex in the pump flow path while being substantially separated from the liquid present near the bottom of the pump flow path. The bubbles are then discharged out of the pump casing assembly through the through-hole much larger in sectional area than the gas venting path while being substantially free from flow resistance. Thus, the bubbles formed in the pump flow path are removed out of the pump casing assembly with high efficiency; that is, the problems of bubbles staying in the pump casing assembly is eliminated according to the invention.

The nature, principle and utility o the invention will becomes more apparent from the following detailed description when read in conjunction with the accompanying drawings, in which like parts are designated by like reference numerals.

DETAILED DESCRIPTION OF THE INVENTION

Figure 1:
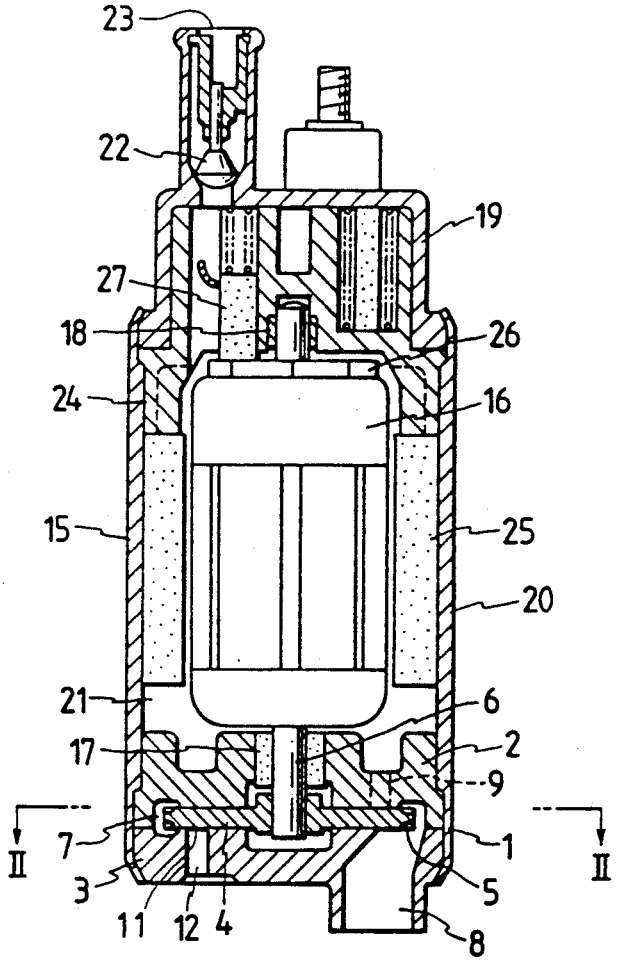
FIG. 1 is a vertical sectional view showing one example of a circumferential flow type liquid pump according to this invention.

One example of a circumferential flow type liquid pump according to this invention will be described with reference to FIGS. 1 through 3.

In these figures, reference numeral 1 designates a pump casing assembly which comprises a pump casing body 2 and a cover 3. The pump casing assembly 1 accommodates an impeller 4 with vanes 5 on its periphery. The impeller 4 is mounted on a central shaft 6 so that it is rotated around the central axis with respect to the pump casing assembly 1.

In the pump casing assembly 1, an arcuate elongated pump flow path 7 with a suction inlet 8 and a discharge outlet 9 at both ends is defined in such a manner that it extends along the outer periphery of the impeller 4 and receives the vanes 5 of the impeller 4.

Figure 2:
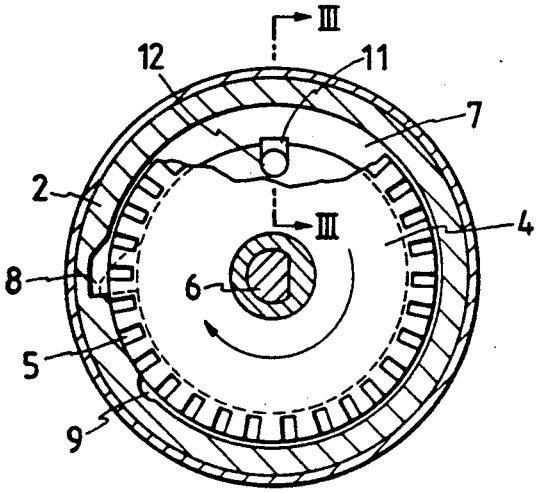
FIG. 2 is a sectional view taken along line II—II in FIG. 1.
Figure 3:
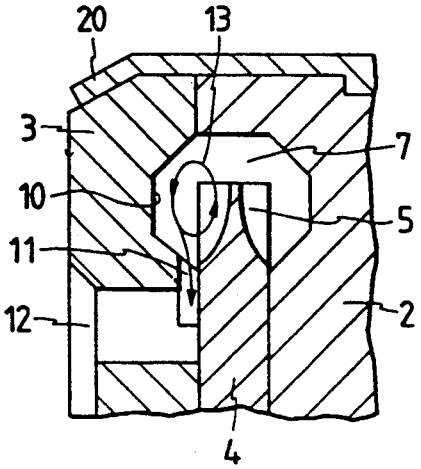
FIG. 3 is an enlarged sectional view taken along line III—III in FIG. 2.
Figure 4:
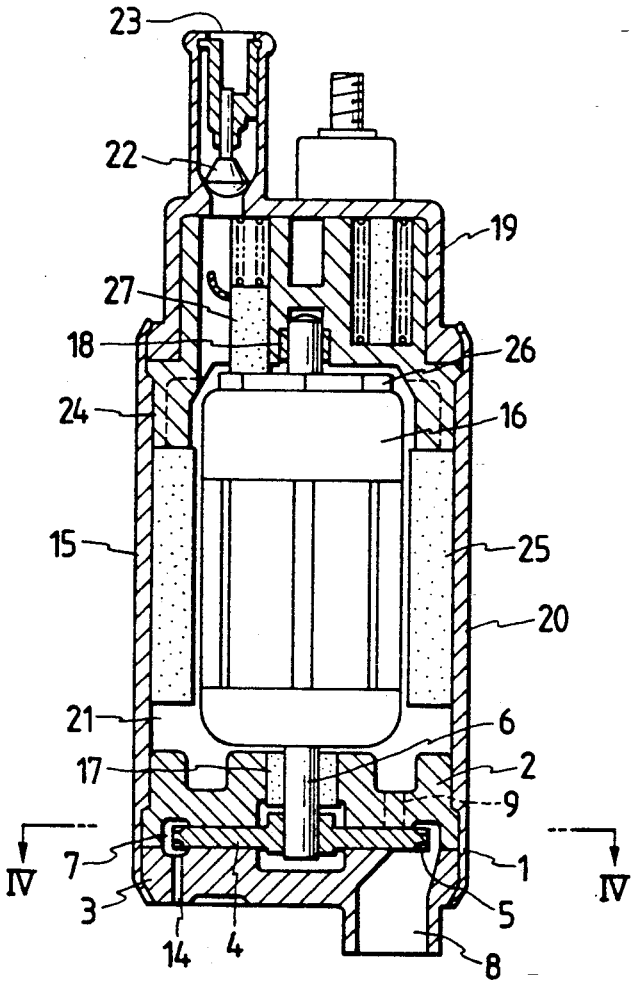
FIG. 4 (PRIOR ART)
FIG. 4 is a vertical sectional view showing a conventional circumferential flow type liquid pump.
Figure 5:
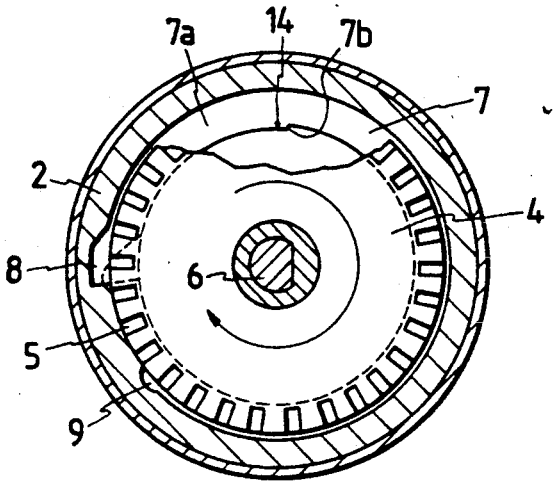
FIG. 5 (PRIOR ART)
FIG. 5 is a sectional view taken along line IV—IV in FIG. 4.

The pump casing assembly 1, or more specifically the cover 3, as shown in FIG. 3, has a gas venting path 11 and a through-hole 12 which is much larger in sectional area than the gas venting path 11. The gas venting path 11 is opened in the inner periphery of the pump flow path 7 near the impeller and is separated by a step from the bottom 10 of the pump flow path 7. The gas venting path 11 is communicated via the through-hole 12 with the outside of the pump casing assembly 1. As can be seen from FIG. 2, the gas venting path 11 has an inner end opposing the inner peripheral wall of the through-hole 12.

The sectional areas of the gas venting path 11 and the through-hole 12 depend on the capacity of the pump. In the case of an ordinary vehicle, the gas venting path 11 is rectangular in section, for instance, 4 mm in width and 0.2 mm in height, and the through-hole 12 is a circular hole measuring 2.5 mm in diameter, for example.

The central shaft 6 of the impeller 4 is the rotary shaft of the rotor 16 of an electric motor 15 coupled to the circumferential flow type liquid pump. The shaft of the rotor 16 is rotatably supported at both ends through bearings 17 and 18 by the pump casing assembly 1 and a bracket 24.

The pump casing assembly 1 is coupled to an end cover through the yoke 20 of the motor 15. The yoke 20 accommodates the rotor 16 and forms a liquid chamber 21 between the pump casing assembly 1 and the end cover 19 to store a liquid such as liquid fuel discharged through the discharge outlet 9. Permanent magnets 25 serving as a stator are mounted on the inner wall of the yoke. The liquid chamber 21 is communicated with a liquid outlet 23 with a check valve 22 which is provided in the end cover 19. The bracket 24 supports brushes 27 which are held in sliding contact with the commutator 26 of the rotor 16.

In the circumferential flow type liquid pump thus constructed, as the impeller 4 is rotated clockwise, in FIG. 2, by the motor 15, a liquid such as liquid fuel is sucked into the pump flow path 7 through the suction inlet 8. The liquid thus sucked flows clockwise, in FIG. 2, and flows through the discharge outlet 9 into the liquid chamber 21. During this pumping operation, the vanes 5 of the impeller 4 contact the liquid in the pump flow path 7 to vaporize it, thus forming bubbles in it. The bubbles thus formed are different from the liquid both in centrifugal force and in specific gravity. Hence, they are allowed to flow together with the liquid while being collected along the inner periphery of the pump flow path 7 near the impeller; that is, they flow in the same direction as the impeller 4. When the bubbles come to the gas venting path 11 which, as was described before, is opened in the inner periphery of the pump flow path 7 near the impeller and separated by a step from the bottom 10 of the pump flow path 7 and is extended in the same direction as the vortex 13 formed in the pump flow path 7 by the impeller, the static pressure induced in the pump flow path 7 by pumping and the dynamic pressure of the vortex 13 formed in the pump flow path 7 by the impeller act on the bubbles collected near the impeller, so that the bubbles are caused to flow into the gas venting path 11 while being substantially separated from the liquid present near the bottom 10 of the pump flow path. The bubbles thus moved into the gas venting path 11 are discharged out of the pump casing assembly 1 through the through-hole 12 which is much larger in section than the gas venting path, so it is substantially free from flow resistance.

As was described above, in the circumferential flow type liquid pump, the pump casing assembly includes the gas venting path 11 which is opened in the inner periphery of the pump flow path 7 near the impeller 4 with the step extended from the bottom of the pump flow path and which extends radially inwardly, and the through-hole 12 which is much larger in sectional area than the gas venting path 11 communicating the gas venting path 11 with the outside of the pump casing assembly 1. Hence, the bubbles formed by vaporizing the liquid in the pump flow path 7 are discharged out of the pump casing assembly 1 forcibly through the gas venting path 11 and the through-hole 12 by the static pressure and dynamic pressure induced in the pump flow path 7 while being substantially separated from the liquid. Therefore, the bubbles formed in the liquid in the pump flow path are discharged positively with high efficiency; that is, the problem of bubbles remaining in the pump flow path and lowering the pumping capacity is eliminated.

While a preferred embodiment of this invention has been described, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A circumferential flow type liquid pump comprising an impeller with vanes on the outer periphery thereof, and a pump casing assembly defining an arcuate elongated pump flow path along the outer periphery of said impeller and a suction inlet and a discharge output at both ends of said pump flow path, in which said pump casing assembly includes:

a gas venting path which is opened in the inner periphery of said pump flow path near said impeller and is separated by a step from the bottom of said pump flow path; and a through-hole much larger in sectional area than said gas venting path, through which said gas venting path is communicated with the outside of said pump casing assembly.

2. A circumferential flow type liquid pump according to claim 1 wherein said gas venting path extends in the radial direction of said impeller.

3. A pump as claimed in claim 1 wherein the through-hole has a peripheral wall extending substantially to a surface of the impeller.

4. A pump as claimed in claim 3 wherein the gas venting path has an inner end opposing the peripheral wall of the through-hole.

5. A circumferential flow type liquid pump comprising:

a pump casing including an inlet, an outlet, and a generally annular flow passage extending between the inlet and the outlet and having a bottom surface and a step extending from the bottom surface;

an impeller rotatably mounted in the pump casing and having a plurality of vanes disposed in the annular flow passage;

a gas venting passage formed in the step and extending substantially radially with respect to the impeller and having an inner end and an outer end, the outer end opening onto the annular flow passage above the bottom surface of the annular flow passage; and a through-hole having a larger cross section than the gas venting passage and communicating between the inner end of the gas venting passage and the outside of the pump casing.

6. A pump as claimed in claim 5 wherein the outer end of the gas venting passage is closer to the inlet than to the outlet.

7. A pump as claimed in claim 5 wherein the gas venting passage has side walls for guiding gas through the gas venting passage.

* * * * *